US012662740B2

(12) United States Patent
Suzuki et al.

(10) Patent No.: US 12,662,740 B2
(45) **Date of Patent: *Jun. 23, 2026**

(54) STEEL SHEET FOR HOT STAMPING AND HOT-STAMPED MEMBER

(71) Applicant: NIPPON STEEL CORPORATION, Tokyo (JP)

(72) Inventors: Yuki Suzuki, Tokyo (JP); Kenta Uenishi, Tokyo (JP); Soshi Fujita, Tokyo (JP); Masahiro Fuda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 125 days.

This patent is subject to a terminal disclaimer.

(21) Appl. No.: 18/280,553

(22) PCT Filed: Apr. 8, 2021

(86) PCT No.: PCT/JP2021/014909
§ 371 (c)(1),
(2) Date: Sep. 6, 2023

(87) PCT Pub. No.: WO2022/215229
PCT Pub. Date: Oct. 13, 2022

(65) Prior Publication Data

US 2024/0150901 A1 May 9, 2024

(51) Int. Cl.
*C23C 28/00* (2006.01)

(52) U.S. Cl.
CPC ..... *C23C 28/3455* (2013.01)

(58) Field of Classification Search
CPC ..... C23C 28/3455
USPC ..... 428/701
See application file for complete search history.

(56) References Cited

U.S. PATENT DOCUMENTS

| | | | |
|---|---|---|---|
| 2014/0048181 | A1 | 2/2014 | Banik et al. |
| 2017/0016086 | A1 | 1/2017 | Sanadres et al. |
| 2018/0044809 | A1 | 2/2018 | Kawamura et al. |
| 2018/0079174 | A1 | 3/2018 | Kawamura et al. |

FOREIGN PATENT DOCUMENTS

| | | | |
|---|---|---|---|
| EP | 3 733 321 | A1 | 11/2020 |
| JP | 2002-226783 | A | 8/2002 |
| JP | 2003-126921 | A | 5/2003 |
| JP | 2011-149084 | A | 8/2011 |
| JP | 2017-518438 | A | 7/2017 |
| WO | WO 2019/186891 | A1 | 10/2019 |

*Primary Examiner* — Katherine A Christy

(74) *Attorney, Agent, or Firm* — Birch, Stewart, Kolasch & Birch, LLP

(57) ABSTRACT

A steel sheet for hot stamping that further improves productivity of a hot-stamped member, has excellent appearance and has excellent spot weldability, and a hot-stamped member. The steel sheet for hot stamping includes, on the whole of at least one surface of the steel sheet, a surface-treated film whose emissivity at a wavelength of 8.0 μm at 25° C. is 60% or more, in which the surface-treated film contains carbon black, and one or more of oxides selected from a Zr oxide, a Zn oxide, and a Ti oxide, in which the carbon black and the oxides exist while being dispersed over the entire surface-treated film, the surface-treated film has a silica content of 0 to 0.3 g/m$^2$, and when an adhesion amount of the carbon black and an adhesion amount of the oxides are set to $X_{CB}$ (g/m$^2$) and $X_{Oxide}$ (g/m$^2$), respectively, an equation (1) is satisfied.

6 Claims, No Drawings

STEEL SHEET FOR HOT STAMPING AND HOT-STAMPED MEMBER

TECHNICAL FIELD

The present invention relates to a steel sheet for hot stamping and a hot-stamped member.

BACKGROUND ART

In recent years, a demand for suppressing chemical fuel consumption is increasing for protecting environment and preventing global warming, and this demand exerts an influence on various manufacturing industries. For example, an automobile that is indispensable for daily lives and activities as a transport means, is also not an exception, and it is required to realize improvement of fuel efficiency and the like by a reduction in weight of vehicle body and the like. However, in an automobile, realization of a simple reduction in weight of vehicle body may reduce safety, which is therefore not allowed in terms of product quality. Accordingly, when performing a reduction in weight of vehicle body, it is required to secure proper safety.

Many of structures of an automobile are formed of iron, particularly steel sheets, and a reduction in weight of steel sheets is important for a reduction in weight of vehicle body. Further, such a demand for steel sheets is made in not only an automobile manufacturing industry but also various manufacturing industries. In response to such a demand, if a weight of steel sheet is simply reduced, it can be considered to reduce a sheet thickness of the steel sheet. However, the reduction in sheet thickness of the steel sheet leads to a reduction in strength of a structure. Accordingly, in recent years, research and development are conducted regarding a steel sheet whose mechanical strength is increased so that even if its thickness is made thinner than a previously-used steel sheet, it can maintain or increase mechanical strength of a structure composed of the steel sheet.

Generally, in a material having high mechanical strength, shape fixability tends to be lowered during molding working such as bending. Accordingly, when the material is worked into a complicated shape, it becomes difficult to perform the working itself. As one of measures for solving the problem regarding the moldability, there can be cited a so-called "hot stamping method (also called a hot pressing method, a hot press method, a high-temperature pressing method, or a die-quenching method)." In this hot stamping method, a material being a molding target is heated to a high temperature to be transformed into a structure called austenite (austenitized), the steel sheet softened by the heating is molded by press working, and cooling is performed after the molding. According to this hot stamping method, the material is once heated to a high temperature to be softened, and thus the material can be easily subjected to the press working. Besides, the mechanical strength of the material can be increased by a quenching effect of the cooling after the molding. Therefore, by using this hot stamping method, it is possible to obtain a molded product having favorable shape fixability and high mechanical strength.

For example, Patent Document 1 below discloses a technique in which an alloyed hot-dip galvanized steel sheet is worked by a hot stamping method, to thereby manufacture a molded product capable of being used as an automotive member. Further, each of Patent Document 2 and Patent Document 3 below discloses a technique in which a film mainly composed of organic matters such as carbon pigments is provided to an upper layer of an aluminum-plated steel sheet, to thereby shorten a period of time for performing heating to a desired temperature.

PRIOR ART DOCUMENT

Patent Document

Patent Document 1: Japanese Laid-open Patent Publication No. 2003-126921

Patent Document 2: Japanese Laid-open Patent Publication No. 2011-149084

Patent Document 3: Japanese Translation of PCT International Application Publication No. JP-T-2017-518438

DISCLOSURE OF THE INVENTION

Problems to be Solved by the Invention

Here, in the hot stamping method described in Patent Document 1, the steel sheet to be a working target has to be heated to an Ac3 point or higher, so that there is a need to secure a period of time for heating the steel sheet to the desired temperature, which leaves room for improvement in terms of improvement of productivity. Further, in the method described in each of Patent Document 2 and Patent Document 3, all of the carbon pigments and so on contained in the film are the organic matters, and thus they are eliminated at a high temperature of 750° C. or more, which leaves room for improvement in terms of improvement of productivity.

Accordingly, the present invention has been made in view of the above-described problems, and an object thereof is to provide a steel sheet for hot stamping capable of further improving productivity of a hot-stamped member, excellent in appearance, and excellent in spot weldability, and a hot-stamped member.

Means for Solving the Problems

The present inventors conducted earnest studies for solving the above-described problems, and consequently, they came up with an idea that, if it is possible to increase a heating rate when a steel sheet is heated to a desired temperature of an Ac3 point or higher, a heating time can be reduced, which can contribute to improvement of productivity. Further, they came up with a steel sheet for hot stamping excellent in appearance and excellent in spot weldability.

The gist of the present invention completed based on such findings is as follows.

[1] A steel sheet for hot stamping includes, on the whole of at least one surface of the steel sheet, a surface-treated film whose emissivity at a wavelength of 8.0 μm at 25° C. is 60% or more, in which the surface-treated film contains carbon black, and one or more of oxides selected from a group consisting of a Zr oxide, a Zn oxide, and a Ti oxide, in which the carbon black and the oxides exist while being dispersed over the entire surface-treated film, the surface-treated film has a silica content of 0 to 0.3 g/m$^2$, and when an adhesion amount of the carbon black and an adhesion amount of the oxides are set to $X_{CB}$ (g/m$^2$) and $X_{Oxide}$ (g/m$^2$), respectively, an equation (1) below is satisfied.

$$118.9 \leq 24280/\{6700/(100+76\times X_{CB})+18000/(130+65\times X_{Oxide})\} \leq 332.0 \quad \text{Equation (1)}$$

[2] In the steel sheet for hot stamping described in [1], the surface-treated film contains the carbon black of 5.0 to 40.0 vol %, and contains the oxides of 1.0 to 30.0 vol %.

[3] In the steel sheet for hot stamping described in [1] or [2], a ratio $X_{Oxide}/X_{CB}$ between the adhesion amount $X_{CB}$ (g/m$^2$) of the carbon black and the adhesion amount $X_{Oxide}$ (g/m$^2$) of the oxides is 0.20 or more and 200.00 or less.

[4] In the steel sheet for hot stamping described in any one of [1] to [3], the adhesion amount $X_{CB}$ of the carbon black is 0.030 g/m$^2$ or more, and the adhesion amount $X_{Oxide}$ of the oxides is 0.030 g/m$^2$ or more.

[5] In the steel sheet for hot stamping described in any one of [1] to [4], an emissivity of the surface-treated film at a wavelength of 8.0 μm at 700° C. is 60% or more.

[6] In the steel sheet for hot stamping described in any one of [1] to [5], on one side or both sides of the steel sheet for hot stamping, a metal-plated layer is provided between a base material of the steel sheet and the surface-treated film.

[7] A hot-stamped member includes a surface-treated film on the whole of at least one surface of a steel sheet, in which the surface-treated film contains one or more of oxides selected from a group consisting of a Zr oxide, a Zn oxide, and a Ti oxide, in which an adhesion amount $X_{Oxide}$ of the oxides is 0.030 g/m$^2$ or more, and the surface-treated film has a silica content of 0 to 0.3 g/m$^2$.

Effect of the Invention

As described above, according to the present invention, it is possible to obtain a steel sheet for hot stamping capable of further improving productivity of a hot-stamped member, excellent in appearance, and excellent in spot weldability.

EMBODIMENTS FOR CARRYING OUT THE INVENTION

Hereinafter, preferred embodiments of the present invention will be described in detail.

(Steel Sheet for Hot Stamping)

A steel sheet for hot stamping according to an embodiment of the present invention to be described below, is one capable of improving, when manufacturing a hot-stamped member, not only productivity of the hot-stamped member but also an appearance and spot weldability by increasing a heating rate at a time of heating the steel sheet. Such a steel sheet for hot stamping has, on the whole of at least one surface of the steel sheet, a surface-treated film whose emissivity at a wavelength of 8.0 μm at ° C. is 60% or more. In the present embodiment, by providing the surface-treated film on the whole of at least one surface of the steel sheet as described above, the emissivity at the wavelength of 8.0 μm at 25° C. can be increased to 60% or more, and it is possible to increase the heating rate when such a steel sheet is heated.

In the steel sheet for hot stamping according to the present embodiment, a kind of a steel sheet to be a base metal (base steel sheet) is not particularly limited. As such a steel sheet, there can be cited, for example, various hot-rolled steel sheets, cold-rolled steel sheets, and plated steel sheets. The plated steel sheets include steel sheets on which, for example, hot-dip aluminum plating, hot-dip galvanizing, alloying hot-dip galvanizing, electrogalvanizing, or the like is performed, but not limited to these plated steel sheets as long as they can be applied to hot stamping.

Conventionally, many of steel sheets used as automotive framework components and the like have been hot-rolled steel sheets, cold-rolled steel sheets, or plated steel sheets after being subjected to plating of aluminum, zinc, or the like. These steel sheets have low emissivity, and thus a heating rate thereof with respect to radiation heating at a wavelength of approximately 8.0 μm is low.

In the present embodiment, by providing a specific surface-treated film on the whole of at least one surface of the steel sheet, a heating rate during hot-stamping heating is increased. Hot stamping is performed on the heated steel sheet, which enables to make the whole surface of the steel sheet to be quickly quenched to be turned into a quenched structure (martensite structure).

In the present embodiment, the surface-treated film with high emissivity is provided on the whole of at least one surface of the steel sheet. Concrete methods for providing the surface-treated film include a method of painting, laminating, or the like, but not limited to these methods. The surface-treated film as described above may be provided only on one side of the steel sheet or both sides of the steel sheet. The emissivity at the wavelength of 8.0 μm at 25° C. of a region provided with the surface-treated film is 60% or more. The emissivity at the wavelength of 8.0 μm at 25° C. of the region provided with the surface-treated film, is preferably 70% or more, and more preferably 80% or more.

Note that a measurement method of the emissivity can be conducted according to JIS R 1801 (2002) of Japanese Industrial Standards. In this case, a sample is set to a Fourier transform infrared spectrophotometer, and radiation intensity at a wavelength of 8.0 μm at 25° C. is measured, to thereby calculate an emissivity.

Further, it is also possible that a radiation thermometer in which a measuring wavelength is set to 8.0 μm is used to measure radiation intensity of a focused site at 25° C., and an emissivity is calculated from a ratio with respect to radiation intensity of a blackbody.

When the surface-treated film is provided on the whole surface of the steel sheet through painting, the surface-treated film can be provided in a manner that, for example, the whole surface of the steel sheet is painted with an organic or inorganic treatment solution containing carbon black and metal oxides by a roll coater, a curtain coater, or ink jet and then a volatile component in the treatment solution is dried.

In the painting by ink jet, in particular, it is also possible to continuously change a film thickness.

<Surface-Treated Film>

In the steel sheet for hot stamping according to the present embodiment, the emissivity at the wavelength of 8.0 μm at 25° C. of the surface on the side provided with the surface-treated film, is 60% or more. When the emissivity at the wavelength of 8.0 μm at 25° C. becomes less than 60%, it becomes difficult to efficiently use radiation heating, and thus it is not possible to increase the heating rate. The emissivity at the wavelength of 8.0 μm at 25° C. is preferably 80% or more. When the emissivity at the wavelength of 8.0 μm at 25° C. becomes 80% or more, it becomes possible to more efficiently use the radiation heating, which enables to further increase the heating rate. Note that the emissivity at the wavelength of 8.0 μm at 25° C. of the surface on the side provided with the surface-treated film is preferably as high as possible, and its upper limit value is not defined and may be 100%.

In order to make the emissivity at the wavelength of 8.0 μm at 25° C. to be 60% or more, the surface-treated film according to the present embodiment contains carbon black and specific metal oxides as will be described in detail hereinbelow. Further, the surface-treated film according to the present embodiment may further contain a binder component, various additives, and the like according to need. Besides, the surface-treated film according to the present embodiment may not contain silica, or it may contain silica within a certain range. It becomes possible to realize the desired emissivity by adjusting contents of the carbon black, the metal oxides, and the like, a film thickness of the surface-treated film, and so on.

More specifically, the surface-treated film according to the present embodiment contains carbon black, and one or more of oxides selected from a group consisting of a Zr oxide, a Zn oxide, and a Ti oxide, in which the carbon black and the oxides exist while being dispersed over the entire surface-treated film. Further, when an adhesion amount of the carbon black is expressed as $X_{CB}$ (g/m$^2$), and an adhesion amount of the oxides is expressed as $X_{Oxide}$ (g/m$^2$), the surface-treated film according to the present embodiment satisfies a relation expressed by an equation (1) below.

$$118.9 \leq 24280/\{6700/(100+76\times X_{CB})+18000/(130+65\times X_{Oxide})\} \leq 332.0 \quad \text{Equation (1)}$$

The above (equation 1) defines a relational expression between an increase factor (%) of the heating rate (° C./s) and the adhesion amounts of the carbon black and the oxides. More specifically, the equation formulates the fact that, regarding the increase factor of the heating rate, the carbon black functions as a heat absorption material within a range of up to 700° C., and in a range of 700° C. or more, the Zr oxide, the Zn oxide, and the Ti oxide that remain even in such a temperature zone function as a heat absorption material.

As briefly described before, the surface-treated film according to the present embodiment can be formed by applying a treatment solution containing the carbon black and the specific oxides to a surface of the steel sheet. As a result of this, in the surface-treated film according to the present embodiment, the carbon black and the oxides exist while being dispersed over the entire surface-treated film. When the carbon black and the oxides exist while being dispersed over the entire surface-treated film, the emissivity of the surface-treated film at the wavelength of 8.0 μm at 25° C. can be uniformized over the entire film. Consequently, when heating the steel sheet for hot stamping according to the present embodiment, it is possible to rapidly heat the entire surface-treated film with no unevenness.

Such a distribution state of the carbon black and the oxides can be checked by performing, with the use of an EPMA (Electron Probe Micro Analyzer), plane analysis on the surface-treated film regarding an element derived from the carbon black (C, for example), and elements derived from the oxides (namely, Zr, Zn, and Ti).

Note that when a treatment solution containing the carbon black and a treatment solution containing the oxides are separately prepared, and these treatment solutions are separately applied to form a stacked film, the carbon black and the oxides do not exist while being dispersed over the entire film. Further, when the film is tried to be formed by using the plurality of treatment solutions as above, the film of the second layer has to be formed after the formation of the film of the first layer, which increases not only the size of a manufacturing facility but also a manufacturing cost.

Further, regarding the surface-treated film according to the present embodiment, when the adhesion amount $X_{CB}$ of the carbon black and the adhesion amount $X_{Oxide}$ of the oxides satisfy the relation expressed by the above equation (1), the emissivity at the wavelength of 8.0 μm at 25° C. becomes 60% or more, resulting in that the degree of increase in the heating rate becomes noticeable. When a value defined by a middle term of the above equation (1) becomes less than 118.9, the adhesion amounts of the carbon black and the oxides are insufficient, resulting in that the emissivity as described above cannot be realized. The value defined by the middle term of the above equation (1) is preferably 119.0 or more, more preferably 170.0 or more, and still more preferably 220.0 or more. On the other hand, it is not preferable that the value defined by the middle term of the above equation (1) exceeds 332.0, since the adhesiveness of the film is lowered. The value defined by the middle term of the above equation (1) is preferably 330.0 or less, more preferably 310.0 or less, and still more preferably 300.0 or less.

Here, the adhesion amount $X_{CB}$ of the carbon black in the surface-treated film can be measured as follows by a cross-sectional analysis of the surface-treated film by using a TEM (Transmission Electron Microscope). Specifically, a range of a region expressed by a film thickness×5 μm is subjected to a cross-sectional analysis based on a TEM-EDS analysis, to thereby measure a film thickness of the surface-treated film and an area ratio occupied by particles whose carbon content becomes 70 mass % or more. When the film thickness is set to d (μm), and the area ratio is set to a (%), a value expressed by d×a corresponds to the adhesion amount $X_{CB}$ (g/m$^2$) of the carbon black.

Further, the adhesion amount $X_{Oxide}$ of the oxides of at least one kind of elements of Zr, Zn, and Ti in the surface-treated film, means an amount of a Zr oxide, a Zn oxide, and a Ti oxide (namely, $ZrO_2$, ZnO, and $TiO_2$) adhered per unit area as metal Zr, metal Zn, and metal Ti. The adhesion amount $X_{Oxide}$ of these oxides can be determined in a manner that a fluorescent X-ray analysis apparatus (ZSX Primus manufactured by Rigaku Corporation) is used to perform an elemental analysis from a surface of the surface-treated film, thereby determining quantities of the metal Zr, the metal Zn, and the metal Ti.

The steel sheet for hot stamping according to the present embodiment has the characteristic as described above, and thus it is possible to make an emissivity at a wavelength of 8.0 μm at 700° C. to be 60% or more. Hereinafter, the substances contained by the surface-treated film and characteristic for realizing the emissivity as described above, will be described in more detail.

<<Carbon Black>>

On the side provided with the surface-treated film, of the surface of the steel sheet, the adhesion amount $X_{CB}$ of the carbon black in the surface-treated film is preferably 0.030 g/m$^2$ or more. By making the adhesion amount $X_{CB}$ to be 0.030 g/m$^2$ or more, it is possible to securely increase the heating rate in a region of up to 700° C. The adhesion amount $X_{CB}$ is more preferably 0.100 g/m$^2$ or more. On the other hand, an upper limit value of the adhesion amount $X_{CB}$ becomes a value determined by the above equation (1). The adhesion amount $X_{CB}$ is preferably 0.800 g/m$^2$ or less, and more preferably 0.600 g/m$^2$ or less.

Further, it is more preferable that the surface-treated film contains the carbon black of 5.0 to 40.0 vol %. The carbon black brings about an effect of increasing the heating rate in a region of up to 700° C., in particular. A thickness of the surface-treated film is locally different in some cases according to roughness or undulation of a steel sheet, a difference in speed at which a volatile component such as water in the treatment solution volatilizes during the film formation, or the like. At this time, when the content of carbon black is 5.0 vol % or more, a difference between a portion observed to be blackish due to the carbon black and the other portion can be suppressed to keep design, which is preferable in appearance. On the other hand, when the content of carbon black in the surface-treated film is 40.0 vol % or less, it is possible to suppress a reduction in paint adhesiveness after performing hot-stamping heating. Although its mechanism is not clarified, it can be inferred that by suppressing the remainder of a compound derived from the remaining carbon black, an oxide of the carbon black, or the like, the prevention of joining between the paint and the base material is suppressed.

Further, since main components of the carbon black are carbon, hydrogen, and oxygen, the carbon black is eliminated when being heated to a high temperature. Accordingly, by making the carbon black to be contained in the surface-treated film, it is possible to maintain performance after the hot stamping such as post-painting adhesiveness.

When the content of carbon black is 5.0 vol % or more, oxidation of a steel sheet or a plated layer positioned at a lower layer of the surface-treated film is suppressed, so that reactivity when applying the paint (treatment agent) is secured, which realizes strong joining and thus keeps the paint adhesiveness. Further, the emissivity can be increased, and thus it is possible to increase the heating rate. The content of carbon black in the surface-treated film is more preferably 8.0 vol % or more. By making the content of carbon black in the surface-treated film to be 8.0 vol % or more, it becomes possible to further increase the heating rate. On the other hand, when the content of carbon black in the surface-treated film is 40.0 vol % or less, it is possible to suppress an increase in a film cost while sufficiently achieving an effect of increasing the emissivity. The content of carbon black in the surface-treated film is more preferably 30.0 vol % or less. By making the content of carbon black in the surface-treated film to be 30.0 vol % or less, it becomes possible to further suppress the film cost.

<<Metal Oxide>>

On the side provided with the surface-treated film, of the surface of the steel sheet, a total adhesion amount $X_{Oxide}$ of the Zr oxide, the Zn oxide, and the Ti oxide in the surface-treated film, is preferably 0.030 g/m$^2$ or more. By making the adhesion amount $X_{Oxide}$ to be 0.030 g/m$^2$ or more, it becomes possible to securely increase the heating rate in a region of 700° C. or more. The adhesion amount $X_{Oxide}$ is more preferably 0.060 g/m$^2$ or more. On the other hand, an upper limit value of the adhesion amount $X_{Oxide}$ becomes a value determined by the above equation (1). The adhesion amount $X_{Oxide}$ is preferably 0.500 g/m$^2$ or less, and more preferably 0.300 g/m$^2$ or less.

Further, it is more preferable that the surface-treated film contains the Zr oxide, the Zn oxide, and the Ti oxide by 1.0 to 30.0 vol % in total. These oxides of elements (namely, the metal oxides of Zr, Zn, and Ti) remain in the surface-treated film even in a case of being heated to a high temperature of 700° C. or more at which the effect of the carbon black becomes weak. As a result of this, at the site provided with the surface-treated film, an emissivity of these metal oxides is higher than that at the surface of the steel sheet or the plating surface at a high temperature of 700° C. or more, resulting in that an input heat amount by radiation heat from a heating atmosphere becomes large. This makes it possible to maintain an effect of increasing the heating rate even under a high temperature of 700° C. or more. When the content of these metal oxides is 1.0 vol % or more, it is possible to sufficiently achieve the effect of increasing the heating rate. The content of these metal oxides is more preferably 3.0 vol % or more. On the other hand, when the content of these metal oxides is 30.0 vol % or less, the film cost can be suppressed, which is economically preferable. The content of these metal oxides is more preferably 25.0 vol % or less.

Note that regarding content ratios (vol %) of the various compounds such as the carbon black and the metal oxides in the surface-treated film, a sample is embedded in a resin, a polished cross section is observed by a scanning electron microscope (SEM), and based on area ratios occupied with respect to the cross section, the content ratios can be calculated. Further, the compounds can be inferred by performing a quantitative analysis by using an EDX function provided to the SEM.

In the surface-treated film according to the present embodiment, a ratio $X_{Oxide}/X_{CB}$ between the adhesion amount $X_{CB}$ (g/m$^2$) of the carbon black and the adhesion amount $X_{Oxide}$ (g/m$^2$) of the oxides described above is preferably 0.20 or more and 200.00 or less. When the ratio $X_{Oxide}/X_{CB}$ falls within the above-described range, it becomes possible to perform more proper heating of the site provided with the surface-treated film. The ratio $X_{Oxide}/X_{CB}$ is more preferably 0.40 to 10.00, and still more preferably 0.60 to 5.00.

Further, in the surface-treated film according to the present embodiment, various binder components and additives, other than the above-described carbon black and metal oxides, can be contained.

<<Binder Component>>

A binder component capable of being contained in the surface-treated film according to the present embodiment, is preferably a water-dispersible or water-soluble resin. A content of the binder component selected from the water-dispersible or water-soluble resin is preferably 40 vol % or more with respect to the entire volume of the surface-treated film.

As the binder component selected from the water-dispersible or water-soluble resin, it is possible to use publicly-known various resins that exhibit water dispersibility or water solubility. As such resins exhibiting the water dispersibility or the water solubility, there can be cited, for example, a polyurethane resin, a polyester resin, an acrylic resin, an epoxy resin, a fluorocarbon resin, a polyamide resin, a polyolefin resin, a polymer compound obtained through hydrolysis and condensation polymerization of a silane coupling agent, and the like. Such a binder component is more preferably one or two or more selected from a group consisting of the polyester resin, the polyurethane resin, the polyolefin resin, the acrylic resin, the epoxy resin, the fluorocarbon resin, and the polyamide resin. Note that when using a plurality of resins as the binder component, a total content of the used plurality of resins is regarded as the content of the binder component.

Note that when using the polyurethane resin as the binder component, the polyurethane resin is preferably a polyether-based polyurethane resin. This is because by using the polyether-based polyurethane resin, it is possible to prevent occurrence of hydrolysis due to acid or alkali when compared to a polyester-based polyurethane resin, and when compared to a polycarbonate-based polyurethane resin, it is possible to secure adhesiveness during working and corrosion resistance of a worked portion by suppressing formation of a hard and fragile film.

It is possible to determine whether or not the polyurethane resin is contained, based on whether or not characteristic absorption is observed at 3330 cm$^{-1}$ (N—H stretching), 1730 cm$^{-1}$ (C═O stretching), 1530 cm$^{-1}$ (C—N), and 1250 cm$^{-1}$ (C—O) in an infrared absorption spectrum obtained by infrared spectroscopy. Further, regarding the content of the polyurethane resin as well, by previously creating a calibration curve indicating a relation between a content and an intensity of characteristic absorption by using a sample whose content is already known, it is possible to specify the content from the obtained intensity of characteristic absorption.

Further, regarding the aforementioned resins other than the polyurethane resin as well, by focusing attention on characteristic absorption derived from a functional group peculiar to each resin, it is possible to determine whether or not the resin is contained and a content thereof, similarly to the aforementioned polyurethane resin.

<<Additive>>

It is possible that the surface-treated film according to the present embodiment contains, as additives when producing a treatment solution before forming the film, various additives such as a leveling agent, a water-soluble solvent, a metal stabilizer, and an etching inhibitor, within a range that does not impair the effect of the present invention.

As the leveling agent, there can be cited, for example, a polyethylene oxide or polypropylene oxide adduct, an acetylene glycol compound, and the like, as a nonionic or cationic surface active agent.

As the water-soluble solvent, there can be cited, for example, alcohols such as ethanol, isopropyl alcohol, t-butyl alcohol, and propylene glycol, cellosolves such as ethylene glycol monobutyl ether and ethylene glycol monoethyl ether, esters such as ethyl acetate and butyl acetate, ketones such as acetone, methyl ethyl ketone, and methyl isobutyl ketone, and the like.

As the metal stabilizer, there can be cited, for example, chelate compounds such as EDTA (ethylenediamine tetraacetic acid) and DTPA (diethylenetriamine pentaacetic acid).

As the etching inhibitor, there can be cited, for example, amine compounds such as ethylenediamine, triethylenepentamine, guanidine, and pyrimidine.

Note that contents of the above-described binder component and additives can also be measured similarly to the case of the carbon black and the metal oxides.

<<Silica>>

As mentioned before, the surface-treated film according to the present embodiment may not contain silica, or it may contain silica within a certain range. More specifically, in the surface-treated film according to the present embodiment, a silica content is 0 to 0.3 g/m$^2$. When the silica of greater than 0.3 g/m$^2$ is contained, a cost is increased even though the temperature increasing effect cannot be expected, which is not economically preferable. Further, the silica is a substance with low electrical conduction, so that the silica content of greater than 0.3 g/m$^2$ is not preferable in terms of weldability after hot stamping. When the silica is contained in the surface-treated film, the silica content is preferably as small as possible. The silica content in the surface-treated film is more preferably 0.10 g/m$^2$ or less, and still more preferably 0.05 g/m$^2$ or less.

<<Film Thickness of Surface-Treated Film>>

A film thickness of the surface-treated film containing the components as described above, is preferably set to 0.5 to 5.0 μm, for example. By making the film thickness of the surface-treated film fall within the above-described range, the emissivity at the wavelength of 8.0 μm at 25° C. can be more securely set to 60% or more. The film thickness of the surface-treated film is more preferably 1.0 to 3.0 μm.

<Metal-Plated Layer>

The steel sheet for hot stamping according to the present embodiment preferably has a metal-plated layer at at least a part between the base steel sheet and the surface-treated film, on one side or both sides of such a steel sheet for hot stamping. By providing the metal-plated layer, it is possible to further improve post-painting corrosion resistance after hot stamping. Further, because of the presence of metal-plated layer, it is possible to prevent generation of iron scale due to heating, at the time of hot stamping. The iron scale contaminates a heating furnace or adheres to a roll used for conveyance, and thus it becomes a load in manufacturing. Accordingly, when the iron scale is generated, a process such as shot blast is required for removing the iron scale, which is not economically preferable.

A type of the metal-plated layer is not limited in particular. As the metal plating forming such a metal-plated layer, there can be cited, for example, aluminum plating, Al—Si plating, galvanizing, alloying galvanizing, Zn—Ni plating, Zn—Al—Mg plating, Zn—Al—Mg—Si plating, and the like.

Further, as a method of forming the metal-plated layer, there can be cited a hot dipping method, an electroplating method, physical vapor deposition, chemical vapor deposition, and so on, but not limited in particular.

<Base Steel Sheet>

Next, the base steel sheet of the steel sheet for hot stamping according to the present embodiment is not limited in particular as long as it is a steel sheet capable of being favorably used for the hot stamping method. As a steel sheet capable of being applied to the steel sheet for hot stamping according to the present embodiment, there can be exemplified, for example, a steel sheet whose chemical components contain, by mass %, C: 0.10 to 0.40%, Si: 0.01 to 0.60%, Mn: 0.50 to 3.00%, P: 0.05% or less, S: 0.020% or less, Al: 0.10% or less, Ti: 0.01 to 0.10%, B: 0.0001 to 0.0100%, and N: 0.010% or less, with the balance made up of Fe and impurities. Further, as a form of the base steel sheet, there can be exemplified a steel sheet such as a hot-rolled steel sheet or a cold-rolled steel sheet, for example. Hereinafter, the chemical components of the base steel sheet will be described in detail. Note that in the following explanation regarding the chemical components of the base steel sheet, the description of "%" means "mass %" unless otherwise specified.

[C: 0.10 to 0.40%]

C is contained for securing intended mechanical strength. When a C content is 0.10% or more, it is possible to sufficiently improve the mechanical strength, and an effect of containing C can be sufficiently achieved. Accordingly, the C content is preferably 0.10% or more. The C content is more preferably 0.20% or more. On the other hand, when the C content is 0.40% or less, it is possible to suppress a reduction in elongation and drawing while hardening the steel sheet and improving the strength of the steel sheet. For this reason, the C content is preferably 0.40% or less. The C content is more preferably 0.35% or less.

[Si: 0.01 to 0.60%]

Si is one of strength improving elements that improve the mechanical strength, and is contained for securing the intended mechanical strength, similarly to C. When a Si content is 0.01% or more, a strength improving effect is sufficiently exhibited, and it is possible to sufficiently improve the mechanical strength. Accordingly, the Si content is preferably 0.01% or more. The Si content is more preferably 0.10% or more. On the other hand, Si is also an easily oxidizable element, and thus when the Si content is 0.60% or less, a reduction in wettability at a time of performing molten Al plating due to an influence of Si oxides formed on a surface layer of the steel sheet is suppressed, which enables to suppress occurrence of unplating. For this reason, the Si content is preferably 0.60% or less. The Si content is more preferably 0.40% or less.

[Mn: 0.50 to 3.00%]

Mn is one of strengthening elements that strengthen steel, and is also one of elements that increase a quenching property. Besides, Mn is an element that is also effective for preventing hot shortness caused by S being one of impurities. When a Mn content is 0.50% or more, these effects can be sufficiently achieved. Accordingly, in order to make the above effects to be securely exhibited, the Mn content is preferably 0.50% or more. The Mn content is more preferably 0.80% or more. On the other hand, Mn is an austenite forming element, so that when the Mn content is 3.00% or less, an amount of a retained austenite phase does not become excessive, and a reduction in strength is suppressed. For this reason, the Mn content is preferably 3.00% or less. The Mn content is more preferably 1.50% or less.

[P: 0.05% or Less]

P is an impurity contained in steel. When a P content is 0.05% or less, it is possible to suppress that P contained in a steel sheet segregates in a crystal grain boundary of the steel sheet to reduce toughness of a base metal of a hot-stamped molded body, and it is possible to suppress a reduction in delayed fracture resistance of the steel sheet. For this reason, the P content is preferably 0.05% or less, and the P content is preferably set to be as small as possible.

[S: 0.020% or Less]

S is an impurity contained in steel. When a S content is 0.020% or less, it is possible to suppress that S contained in the steel sheet forms a sulfide to reduce toughness of the steel sheet, and it is possible to suppress a reduction in delayed fracture resistance of the steel sheet. For this reason, the S content is preferably 0.020% or less, and the S content is preferably set to be as small as possible.

[Al: 0.10% or Less]

Al is generally used for the purpose of deoxidation of steel. On the other hand, when an Al content is 0.10% or less, an increase in Ac3 point of a steel sheet is suppressed, so that a heating temperature required for securing the quenching property of steel during hot stamping can be lowered, which is desirable in hot-stamping manufacturing. Therefore, the Al content in the steel sheet is preferably 0.10% or less, more preferably 0.05% or less, and still more preferably 0.01% or less.

[Ti: 0.01 to 0.10%]

Ti is one of strength enhancing elements. When a Ti content is 0.01% or more, it is possible to sufficiently achieve a strength improving effect and an oxidation resistance improving effect. Accordingly, in order to make the above effects to be securely exhibited, the Ti content is preferably 0.01% or more. The Ti content is more preferably 0.03% or more. On the other hand, when the Ti content is 0.10% or less, for example, formation of a carbide or a nitride is suppressed and softening of steel can be suppressed, resulting in that the intended mechanical strength can be sufficiently obtained. Therefore, the Ti content is preferably 0.10% or less. The Ti content is more preferably 0.08% or less.

[B: 0.0001 to 0.0100%]

B brings about an effect of improving strength by acting during quenching. When a B content is 0.0001% or more, such a strength improving effect can be sufficiently achieved. Accordingly, the B content is preferably 0.0001% or more. The B content is more preferably 0.0010% or more. On the other hand, when the B content is 0.0100% or less, formation of inclusions is reduced to suppress embrittlement of a steel sheet, and a reduction in fatigue strength can be suppressed. For this reason, the B content is preferably 0.0100% or less. The B content is more preferably 0.0040% or less.

[N: 0.010% or Less]

N is an impurity contained in steel. When a N content is 0.010% or less, formation of a nitride caused by N contained in a steel sheet is suppressed, which enables to suppress a reduction in toughness of the steel sheet. Besides, when B is contained in the steel sheet, it is possible to suppress that N contained in the steel sheet bonds to B to reduce an amount of solid-solution B, resulting in that a reduction in a quenching property improving effect of B can be suppressed. For this reason, the N content is preferably 0.010% or less, and the N content is more preferably set to be as small as possible.

Further, the base steel sheet of the steel sheet for hot stamping according to the present embodiment may further contain, as optional additive elements, elements such as Cr, Mo, Ni, Co, Cu, Mo, V, Nb, Sn, W, Ca, REM, O, and Sb.

[Cr: 0 to 1.00%]

Cr is an element that improves the quenching property of a steel sheet. In order to sufficiently achieve such an effect, a Cr content is preferably set to 0.01% or more. On the other hand, by setting the Cr content to 1.00% or less, it is possible to suppress an increase in cost while sufficiently achieving the effect. For this reason, when Cr is contained, the Cr content is preferably set to 1.00% or less.

[Ni: 0 to 2.00%]

[Co: 0 to 2.00%]

Ni and Co are elements capable of increasing the quenching property of steel, and stably securing strength of a steel sheet member after quenching. In order to make such effects to be sufficiently exhibited, a Ni content is preferably set to 0.10% or more, and a Co content is preferably set to 0.10% or more. On the other hand, when the Ni content and the Co content are respectively 2.00% or less, economic efficiency is increased while sufficiently achieving the above effects. For this reason, when Ni is contained, the Ni content is preferably set to 2.00% or less, and when Co is contained, the Co content is preferably set to 2.00% or less.

[Cu: 0 to 1.000%]

Cu is an element capable of increasing the quenching property of steel, and stably securing strength of a steel sheet member after quenching. Further, Cu improves pitting resistance under a corrosive environment. In order to make such effects to be sufficiently exhibited, a Cu content is preferably set to 0.100% or more. On the other hand, when the Cu content is 1.000% or less, economic efficiency is increased while sufficiently achieving the above effects. For this reason, when Cu is contained, the Cu content is preferably set to 1.000% or less.

[Mo: 0 to 1.00%]

Mo is an element capable of increasing the quenching property of steel, and stably securing strength of a steel sheet member after quenching. In order to make such effects to be sufficiently exhibited, a Mo content is preferably set to 0.10% or more. On the other hand, when the Mo content is 1.00% or less, economic efficiency is increased while sufficiently achieving the above effects. For this reason, when Mo is contained, the Mo content is preferably set to 1.00% or less.

[V: 0 to 1.00%]

V is an element capable of increasing the quenching property of steel, and stably securing strength of a steel sheet member after quenching. In order to make such effects to be sufficiently exhibited, a V content is preferably set to 0.10% or more. On the other hand, when the V content is 1.00% or less, economic efficiency is increased while sufficiently achieving the above effects. For this reason, when V is contained, the V content is preferably set to 1.00% or less.

[Nb: 0 to 1.00%]

Nb is an element capable of increasing the quenching property of steel, and stably securing strength of a steel sheet member after quenching. In order to make such effects to be sufficiently exhibited, a Nb content is preferably set to 0.01% or more. On the other hand, when the Nb content is 1.00% or less, economic efficiency is increased while sufficiently achieving the above effects. For this reason, when Nb is contained, the Nb content is preferably set to 1.00% or less.

[Sn: 0 to 1.00%]

Sn is an element that improves pitting resistance under a corrosive environment. In order to make such an effect to be sufficiently exhibited, a Sn content is preferably set to 0.01% or more. On the other hand, when the Sn content is 1.00% or less, a reduction in grain boundary strength is suppressed, which enables to suppress a reduction in toughness. For this reason, when Sn is contained, the Sn content is preferably set to 1.00% or less.

[W: 0 to 1.00%]

W is an element capable of increasing the quenching property of steel, and stably securing strength of a steel sheet member after quenching. Further, W improves pitting resistance under a corrosive environment. In order to make such effects to be sufficiently exhibited, a W content is preferably set to 0.01% or more. On the other hand, when the W content is 1.00% or less, economic efficiency is increased while sufficiently achieving the above effects. For this reason, when W is contained, the W content is preferably set to 1.00% or less.

[Ca: 0 to 0.010%]

Ca is an element that brings about an effect of making inclusions in steel to be fine to improve toughness and ductility after quenching. In order to make such effects to be sufficiently exhibited, a Ca content is preferably set to 0.001% or more, and more preferably set to 0.002% or more. On the other hand, when the Ca content is 0.010% or less, a cost can be suppressed while sufficiently achieving the effects. For this reason, when Ca is contained, the Ca content is preferably set to 0.010% or less, and more preferably set to 0.004% or less.

[REM: 0 to 0.30%]

REM is an element that brings about an effect of making inclusions in steel to be fine to improve toughness and ductility after quenching, similarly to Ca. In order to make such effects to be sufficiently exhibited, a REM content is preferably set to 0.001% or more, and more preferably set to 0.002% or more. On the other hand, when the REM content is 0.30% or less, a cost can be suppressed while sufficiently achieving the effects. For this reason, when REM is contained, the REM content is preferably set to 0.30% or less, and more preferably set to 0.20% or less.

Here, REM indicates 17 elements in total of Sc, Y, and lanthanoid series, and the above-described REM content indicates a total content of these elements. REM is added to molten steel by using an Fe—Si-REM alloy, for example, and this alloy contains Ce, La, Nd, and Pr, for example.

[O: 0.0070% or Less]

O is not an essential element, and is contained as an impurity in steel, for example. O is an element that causes property deterioration of a steel sheet by forming an oxide that becomes a starting point of fracture. Further, an oxide that exists in the vicinity of a surface of the steel sheet becomes a cause of surface flaw, and sometimes deteriorates an appearance grade. For this reason, an O content is preferably as low as possible. Particularly, when the O content is set to 0.0070% or less, the property deterioration can be suppressed, so that the O content is preferably 0.0070% or less. A lower limit of the O content is not particularly limited and may be set to 0%, but in an actual operation, a substantial lower limit of the O content in refining is 0.0005%.

[Sb: 0.100% or Less]

A lower limit of a Sb content is not particularly limited, and may be set to 0%. Sb is an element effective for improving wettability and adhesiveness of plating. In order to achieve this effect, Sb is preferably contained by 0.001% or more. On the other hand, when the Sb content is set to 0.100% or less, it is possible to suppress a flaw generated during manufacturing, and it is also possible to suppress a reduction in toughness. For this reason, the content of Sb is preferably 0.100% or less.

The balance other than the above-described components is made up of Fe and impurities. The base steel sheet may also contain impurities that are inevitably mixed through a manufacturing process and the like. As such impurities, there can be cited Zn (zinc), for example.

The above is the detailed explanation regarding one example of the chemical components of the base steel sheet of the steel sheet for hot stamping according to the present embodiment.

When the site provided with the surface-treated film of the steel sheet having the above-described chemical components is subjected to heating and quenching according to the hot stamping method, it can be turned into a hot-stamped member having tensile strength of about 1000 MPa or more. Further, in the hot stamping method, it is possible to perform press working in a state where a steel sheet is softened at a high temperature, so that molding can be performed easily.

<Manufacture of Hot-Stamped Member>

Various hot-stamped members as exemplified by an automotive framework component can be manufactured by using the steel sheet for hot stamping in which the surface-treated film is provided on the whole of at least one surface of the steel sheet as described above.

First, the surface-treated film is provided on the whole of at least one surface of a metal material such as, for example, a coiled steel sheet. Subsequently, various kinds of working such as cutting and press punching are performed, thereby obtaining the steel sheet for hot stamping according to the present embodiment. Further, it is possible to obtain the steel sheet for hot stamping according to the present embodiment also by providing the surface-treated film to the steel sheet obtained through the cutting, the press punching, or the like. Further, it is possible to continuously change the emissivity by changing the film thickness of the surface-treated film.

The steel sheet for hot stamping after being provided with the surface-treated film as described above, for example, is hot-stamped. As a heating apparatus, there can be cited an ordinary heating apparatus including, for example, an electric heating furnace, a gas heating furnace, a far infrared furnace, or an infrared heater, or the like. At the surface on the side provided with the surface-treated film to increase the emissivity, the heating rate is fast since a heat transfer effect by radiation is large, so that the surface is rapidly heated to a temperature equal to or higher than an Ac3 point or higher at which a metal structure transforms into an austenite phase. Accordingly, in the manufacturing method of the hot-stamped member according to the present embodiment, it is possible to further improve the productivity of the hot-stamped member by reducing the heating time. In the present embodiment, concrete heating conditions are not limited in particular, and the heating apparatus to be used and the like may be properly controlled.

Next, the heated steel sheet is molded and cooled. The site heated to equal to or higher than the temperature of Ac3 point at which the metal structure of the steel material transforms into the austenite phase, is quenched so that the strength thereof is increased. Consequently, it is possible to obtain a hot-stamped member having strength improved by the quenching.

As described above, by using the fact that the heating rate is continuously changed by changing the film thickness of the surface-treated film, it is also possible to continuously change the hardness. At the site having a large film thickness of the surface-treated film, the austenitizing proceeds the most because of the large heating rate, and the strength is increased because of generation of martensite during quenching at the time of cooling. On the other hand, at the site with a small film thickness, an austenite phase ratio during heating becomes low, and when compared to the site with a large film thickness, a generation amount of martensite becomes small, which lowers the strength.

<Hot-Stamped Member>

A hot-stamped member obtained in a manner as above has a surface-treated film on the whole of at least one surface of a steel sheet. Such a surface-treated film contains one or more of oxides selected from a group consisting of a Zr oxide, a Zn oxide, and a Ti oxide, in which an adhesion amount $X_{Oxide}$ of the oxides is 0.030 g/m$^2$ or more. Further, in such a surface-treated film, a silica content is 0 to 0.3 g/m$^2$. The carbon black existing in the surface-treated film of the steel sheet for hot stamping used as a material of the hot-stamped member, is eliminated by being subjected to a process of hot stamping, and the above-described metal oxides remain. The adhesion amount $X_{Oxide}$ of the oxides that exist in the surface-treated film of the hot-stamped member depends on the adhesion amount of the oxides in the surface-treated film of the steel sheet for hot stamping used as the material, and an upper limit value thereof is approximately 0.600 g/m$^2$.

EXAMPLES

Hereinafter, examples of the present invention will be described, in which conditions in the examples are only conditional examples employed for confirming the operability and the effects of the present invention, and the present invention is not limited by the conditional examples. The present invention can employ various conditions as long as the object of the present invention is achieved without departing from the gist of the present invention.

As a base steel sheet, it is preferable to use a steel sheet having high mechanical strength (meaning various properties regarding mechanical deformation and fracture, such as tensile strength, a yield point, elongation, drawing, a hardness, an impact value, and fatigue strength). Chemical components of base steel sheets before plating, each used for a steel sheet for hot stamping described in the following examples, are shown in Table 1 below.

TABLE 1

| STEEL | CHEMICAL COMPONENT (mass %) BALANCE IS MADE UP OF IRON AND IMPURITIES. | | | | | | | | | | | | | | | | | | |
|---|---|---|---|---|---|---|---|---|---|---|---|---|---|---|---|---|---|---|---|
| No. | C | Si | Mn | P | S | Al | Ti | B | N | Cr | Cu | Ni | Nb | V | Mo | W | Sn | Ca | REM |
| S1 | 0.11 | 0.21 | 1.21 | 0.02 | 0.005 | 0.05 | 0.02 | 0.0030 | 0.005 | — | — | — | — | — | — | — | — | — | — |
| S2 | 0.40 | 0.01 | 1.01 | 0.04 | 0.010 | 0.03 | 0.04 | 0.0022 | 0.004 | — | — | — | — | — | — | — | — | — | — |
| S3 | 0.23 | 0.60 | 0.90 | 0.03 | 0.010 | 0.04 | 0.03 | 0.0022 | 0.003 | — | — | — | — | — | — | — | — | — | — |
| S4 | 0.31 | 0.01 | 0.50 | 0.04 | 0.010 | 0.04 | 0.04 | 0.0022 | 0.008 | — | — | — | — | — | — | — | — | — | — |
| S5 | 0.25 | 0.60 | 3.00 | 0.03 | 0.004 | 0.01 | 0.03 | 0.0030 | 0.003 | — | — | — | — | — | — | — | — | — | — |
| S6 | 0.27 | 0.21 | 1.01 | 0.05 | 0.004 | 0.01 | 0.02 | 0.0030 | 0.004 | — | — | — | — | — | — | — | — | — | — |
| S7 | 0.29 | 0.01 | 0.90 | 0.01 | 0.020 | 0.03 | 0.02 | 0.0030 | 0.009 | — | — | — | — | — | — | — | — | — | — |
| S8 | 0.34 | 0.60 | 1.01 | 0.01 | 0.004 | 0.10 | 0.02 | 0.0025 | 0.004 | — | — | — | — | — | — | — | — | — | — |
| S9 | 0.28 | 0.21 | 1.05 | 0.03 | 0.004 | 0.03 | 0.01 | 0.0029 | 0.005 | — | — | — | — | — | — | — | — | — | — |
| S10 | 0.26 | 0.23 | 0.90 | 0.04 | 0.004 | 0.03 | 0.10 | 0.0087 | 0.005 | 0.22 | — | 0.10 | — | — | — | — | — | — | — |
| S11 | 0.17 | 0.25 | 0.95 | 0.03 | 0.004 | 0.01 | 0.04 | 0.0001 | 0.003 | — | 0.002 | — | 0.04 | — | — | — | — | — | — |
| S12 | 0.33 | 0.21 | 2.01 | 0.04 | 0.004 | 0.01 | 0.03 | 0.0100 | 0.004 | 0.24 | 0.007 | — | — | 0.10 | — | — | — | — | — |
| S13 | 0.27 | 0.03 | 0.90 | 0.02 | 0.010 | 0.01 | 0.02 | 0.0048 | 0.010 | — | — | — | — | — | 0.11 | — | — | — | — |
| S14 | 0.37 | 0.01 | 0.95 | 0.02 | 0.010 | 0.03 | 0.02 | 0.0048 | 0.005 | — | — | — | — | — | — | 0.09 | — | — | — |
| S15 | 0.25 | 0.21 | 0.90 | 0.04 | 0.010 | 0.03 | 0.02 | 0.0029 | 0.008 | — | — | — | — | — | — | — | 0.10 | — | — |
| S16 | 0.33 | 0.12 | 0.50 | 0.04 | 0.008 | 0.04 | 0.04 | 0.0022 | 0.008 | 0.22 | — | — | — | — | — | — | — | 0.003 | — |
| S17 | 0.32 | 0.13 | 0.51 | 0.04 | 0.008 | 0.04 | 0.04 | 0.0022 | 0.008 | — | — | — | — | — | — | — | — | — | 0.10 |
| S18 | 0.30 | 0.14 | 0.53 | 0.04 | 0.009 | 0.04 | 0.04 | 0.0022 | 0.008 | 0.24 | — | — | — | — | — | — | — | — | — |

To each of the base steel sheets having the chemical components shown in Table 1 (steel Nos. S1 to S18), a surface-treated film was provided. More specifically, regarding each base steel sheet, a steel sheet having a width of 100 mm×a length of 200 mm, and a sheet thickness of 1.2 mm was prepared, and to some of the steel sheets, metal plating was applied and then the surface-treated film was provided over the whole surface on one side or both sides. A part of the steel sheets was not provided with the surface-treated film for comparison.

An aqueous treatment solution obtained by adding at least one or more of compounds such as commercially available carbon black, $TiO_2$, $ZrO_2$, ZnO, $Fe_2O_3$, $Fe_3O_4$, CuO, $SiO_2$, TiC, TiN, SiC, and SiN, in addition to an aqueous acrylic resin being a binder component, was applied to a surface of the base steel sheet using an industrial ink-jet printer, and then dried to provide the surface-treated film. Further, in some of the aqueous treatment solutions, silica was further contained, in addition to the above components. Besides, in some verification examples, an aqueous treatment solution to which the carbon black was added and an aqueous treatment solution to which the metal oxide was added, were separately prepared, and the respective treatment solutions were applied in a stacked state. A film thickness of the surface-treated film was set to fall within a range of 1.0 to 2.5 μm, and when the film was provided on both sides, the same kind of film was provided on both sides.

After that, a thermocouple was connected to each of a center portion of the steel sheet provided with the surface-treated film, and a center portion of a steel sheet to which the surface-treated film was not provided, to thereby enable measurement of a temperature at each position. Further, the steel sheets were heated in an electric heating furnace at a set temperature of 920° C., and the steel sheets were taken out of the heating furnace at a point of time where the steel sheet provided with the film reached 880° C. Each of the steel sheets was rapidly cooled by a flat metal mold, to thereby obtain a hot-stamped member.

A radiation thermometer was used to measure radiation intensity at the center portion of the steel sheet provided with the surface-treated film at the wavelength of 8.0 μm at 25° C., and the emissivity (%) was calculated from a ratio with respect to radiation intensity of a blackbody.

Note that to some of the base steel sheets, Al-10 mass % Si plating, Zn plating, Zn-11 mass % Al-3 mass % Mg-0.2 mass % Si, and Al plating were applied by a hot dipping method, or Zn-3 mass % Ni plating was applied by an electroplating method, and then the above-described surface-treated film was provided. In the case of the hot dipping method, the base steel sheet was immersed into a plating bath, and then an adhesion amount was adjusted to 70 g/m$^2$ per one side by a gas wiping method. In the case of the electroplating method, an adhesion amount per one side was adjusted to 20 g/m$^2$.

A film composition of the site provided with the surface-treated film, and a heating rate were examined, and in some of the examples, an appearance, spot weldability after hot stamping, paint adhesiveness, and paint film corrosion resistance after hot stamping were further examined.

Evaluation methods regarding respective evaluation items are as follows.

(1) Heating Rate (Grade)

A heating rate in each steel sheet was calculated based on the temperature change obtained by the thermocouple provided to each steel sheet, and the heating time in the electric heating furnace, to thereby perform evaluation. Specifically, a heating rate until when the temperature reached 910° C. from a room temperature was calculated, and the evaluation was performed based on the following evaluation criteria. A grade "2" was set as acceptance.

2: Heating rate of 3.5° C./s or more

1: Heating rate of 2.0° C./s or more and less than 3.5° C./s (2) Appearance (Grade)

By using a method described in JIS Z 8781-4 (2013) of Japanese Industrial Standards, a CIE 1976 L*a*b* color space was measured at arbitrary five locations within a test piece of 100 mm×100 mm, and a ratio of a maximum value to a minimum value of L* values ($RL^*=L^*_{Max}/L^*value_{Min}$) was evaluated. A grade "2" was set as acceptance.

2: 1.1 or more

1: 1.0 or more and less than 1.1

(3) Spot Weldability after Hot Stamping

Two pieces of sample heated for 6 minutes in the electric heating furnace whose temperature was set to 920° C. and then cooled to the room temperature, were overlapped. The overlapped portion was subjected to spot welding with a DC power source by using a Cr—Cu electrode with a tip diameter of 6 mm at pressurizing force of 400 kg. A current value was increased in increments of 0.5 kA from 7 kA, and a value lower by 0.5 kA than a current value at which expulsion and surface flash occurred two times continuously, was set to an upper limit of an appropriate current range. On the other hand, a sample after welding was embedded, a cross section thereof was polished, a nugget diameter was calculated by a method described in JIS Z 3139 (2009) of Japanese Industrial Standards, and a current value at which the nugget diameter became 5.5 mm or more was set to a lower limit of the appropriate current range. The evaluation criteria are as follows. A grade "2" was set as acceptance.

(Grade)

2: The appropriate current range became 1.0 kA or more.

1: The appropriate current range became less than 1.0 kA.

(4) Paint Film Adhesiveness

On the sample, phosphoric acid chemical treatment, and electrodeposition painting with a thickness of 15 μm were performed, and baking was performed at 170° C. for 20 minutes, to thereby provide a paint film. After that, the sample was immersed in deionized water at 60° C. for 200 hours, and then a peeling state of the paint film was checked. A grade "2" was set as acceptance.

(Grade)

2: Absence of peeling

1: Presence of partial peeling (5) Paint Film Corrosion Resistance after Hot Stamping The paint film provided similarly to (4) was provided with a flaw by means of a cutter, and the paint film corrosion resistance after hot stamping was measured by a method defined by JASO M609 established by Society of Automotive Engineers of Japan. A width (maximum value on one side) of a paint film blister from the cut flaw after a corrosion test of 180 cycles was measured. A grade "2" was set as acceptance.

(Grade)

2: Blister width of less than 3 mm

1: Blister width of 3 mm or more

The evaluation results obtained by examples 1 to 4 performed under the above conditions, are shown in Tables 2, 3, 4, and 5, respectively.

Example 1

In Table 2 below, A1 to A25 are invention examples, and a1 to a7 are comparative examples.

In the present example 1, when preparing the aqueous treatment solution, carbon black and at least any of titanium nitride, titanium carbide, titanium oxide, iron oxide, copper oxide, zirconium oxide, silicon nitride, cobalt oxide, and tin oxide were used as compounds other than the binder component. In the present example, the adhesion amount of the surface-treated film was adjusted, to thereby adjust the value of emissivity at the wavelength of 8.0 μm at 25° C.

In the comparative example a1, the emissivity at the wavelength of 8.0 μm at 25° C. was small to be 57%, and the heating rate during the hot stamping was 2.0° C./s or more and less than 3.5° C./s (grade 1). Further, in the comparative example a2 containing no metal oxide, the emissivity at the wavelength of 8.0 μm at 25° C. became 60%, but since the metal oxide was not contained, the emissivity at 700° C. became 53%, and the heating rate during the hot stamping was 2.0° C./s or more and less than 3.5° C./s (grade 1).

In the comparative examples a3 and a4 in which the silica content was out of the range of the present invention, the evaluation regarding the spot weldability after hot stamping became "1". Further, in the comparative examples a5 and a6 in which the film of the carbon black and the film of the metal oxides were separately formed, the L* value ratio became 1.0 or more and less than 1.1, and thus the grade regarding the appearance became 1. Further, also in the comparative example a7 in which the value of the middle side of the equation (1) was out of the range of the present invention, the L* value ratio became 1.0 or more and less than 1.1, and thus the grade regarding the appearance became 1.

On the other hand, in the invention examples A1 to A25, the emissivity at the wavelength of 8.0 μm at 25° C. was 60% or more. As a result of this, the heating rate became 3.5° C./s or more (grade 2), and regarding the appearance and the spot weldability after hot stamping as well, the grade became 2.

TABLE 2

| | | | | | STEEL SHEET FOR HOT STAMPING | | | | |
|---|---|---|---|---|---|---|---|---|---|
| | REFERENCE No. | STEEL No. | TYPE OF PLATING | FILM FORMING METHOD | EMISSIVITY AT 25° C. (%) | EMISSIVITY AT 700° C. (%) | ADHESION AMOUNT OF SILICA (g/m²) | ADHESION AMOUNT OF CARBON BLACK $X_{CB}$ (g/m²) | CONTENT OF CARBON BLACK (VOL %) |
| INVENTION EXAMPLE | A1 | S1 | Al-10 MASS % Si | MIXED LAYER | 60 | 55 | 0 | 0.012 | 0.50 |
| | A2 | S2 | Zn | MIXED LAYER | 66 | 70 | 0 | 0.021 | 5.00 |
| | A3 | S13 | Zn-11 MASS % Al-3 MASS % Mg-0.2 MASS % Si | MIXED LAYER | 65 | 73 | 0 | 0.054 | 4.43 |
| | A4 | S6 | Al-10 MASS % Si | MIXED LAYER | 86 | 82 | 0 | 0.800 | 25.64 |
| | A5 | S7 | Al-10 MASS % Si | MIXED LAYER | 88 | 83 | 0 | 0.880 | 23.66 |
| | A6 | S4 | Al-10 MASS % Si | MIXED LAYER | 84 | 85 | 0 | 0.480 | 8.89 |
| | A7 | | Al-10 MASS % Si | MIXED LAYER | 81 | 85 | 0 | 0.210 | 4.86 |
| | A8 | S5 | Al-10 MASS % Si | MIXED LAYER | 89 | 86 | 0 | 1.440 | 23.53 |
| | A9 | S6 | Al-10 MASS % Si | MIXED LAYER | 93 | 87 | 0 | 3.000 | 35.21 |
| | A10 | S8 | Al | MIXED LAYER | 60 | 54 | 0 | 0.012 | 0.24 |
| | A11 | S10 | Al-10 MASS % Si | MIXED LAYER | 65 | 58 | 0 | 0.034 | 0.91 |
| | A12 | S11 | Zn-3 MASS % Ni PLATING | MIXED LAYER | 83 | 87 | 0 | 0.480 | 16.67 |
| | A13 | S12 | Al-10 MASS % Si | MIXED LAYER | 80 | 85 | 0 | 0.060 | 0.82 |
| | A14 | S14 | Al-10 MASS % Si | MIXED LAYER | 89 | 86 | 0 | 1.230 | 16.80 |
| | A15 | S15 | Al-10 MASS % Si | MIXED LAYER | 93 | 87 | C | 3.000 | 32.89 |
| | A16 | S16 | Al-10 MASS % Si | MIXED LAYER | 88 | 85 | 0 | 0.800 | 16.26 |
| | A17 | S17 | Al-10 MASS % Si | MIXED LAYER | 60 | 54 | 0 | 0.012 | 0.31 |
| | A18 | S18 | Al-10 MASS % Si | MIXED LAYER | 66 | 55 | 0 | 0.028 | 0.67 |
| | A19 | S8 | Al-10 MASS % Si | MIXED LAYER | 65 | 57 | 0 | 0.065 | 1.32 |
| | A20 | S13 | Al-10 MASS % Si | MIXED LAYER | 88 | 81 | 0 | 0.800 | 10.93 |
| | A21 | S3 | Al-10 MASS % Si | MIXED LAYER | 82 | 83 | 0 | 0.480 | 8.51 |
| | A22 | S8 | Al-10 MASS % Si | MIXED LAYER | 89 | 84 | 0 | 1.480 | 17.37 |
| | A23 | S14 | Al-10 MASS % Si | MIXED LAYER | 93 | 85 | 0 | 3.000 | 25.51 |
| | A24 | S2 | Al-10 MASS % Si | MIXED LAYER | 89 | 86 | 0.3 | 1.400 | 15.56 |
| | A25 | S14 | Al-10 MASS % Si | MIXED LAYER | 93 | 88 | 0.3 | 3.000 | 26.88 |
| COMPARATIVE EXAMPLE | a1 | S1 | Al-10 MASS % Si | MIXED LAYER | 57 | 54 | 0 | 0.008 | 0.33 |
| | a2 | S3 | Al-10 MASS % Si | MIXED LAYER | 60 | 53 | 0 | 0.018 | 0.75 |
| | a3 | S2 | Al-10 MASS % Si | MIXED LAYER | 63 | 81 | 0.6 | 0.090 | 1.47 |
| | a4 | S4 | Al-10 MASS % Si | MIXED LAYER | 68 | 85 | 1.0 | 0.160 | 2.61 |

TABLE 2-continued

| | | | | | | | | |
|---|---|---|---|---|---|---|---|---|
| a5 | S5 | Al-10 MASS % Si | LOWER LAYER CB → UPPER LAYER OXIDE | 68 | 79 | 0 | 0.090 | 4.17 |
| a6 | S1 | Al-10 MASS % Si | LOWER LAYER OXDE → UPPER LAYER CB | 68 | 89 | 0 | 0.160 | 3.25 |
| a7 | S3 | Al-10 MASS % Si | MIXED LAYER | 94 | 88 | 0 | 3.800 | 29.87 |

| | STEEL SHEET FOR HOT STAMPING | | | | | | PROPERTY | | |
|---|---|---|---|---|---|---|---|---|---|
| | | METAL OXIDE | | | | | | | |
| | REFERENCE No. | TYPE | ADHESION AMOUNT $X_{oxide}$ (g/m$^2$) | CONTENT (VOL %) | ADHESION AMOUNT RATIO $X_{oxide}/X_{CB}$ | MIDDLE SIDE OF EQUATION (1) | HEATING RATE | APPEARANCE (COLOR UNIFORMITY) | SPOT WELDABILITY AFTER HOT STAMPING |
| INVENTION EXAMPLE | A1 | $ZrO_2$ | 0.012 | 0.50 | 1.00 | 119.0 | 2 | 2 | 2 |
| | A2 | $ZrO_2$ | 0.018 | 4.28 | 0.86 | 119.5 | 2 | 2 | 2 |
| | A3 | $ZrO_2$ | 0.061 | 5.00 | 1.13 | 122.2 | 2 | 2 | 2 |
| | A4 | $ZrO_2$ | 0.510 | 16.34 | 0.64 | 159.7 | 2 | 2 | 2 |
| | A5 | $ZrO_2$ | 0.510 | 13.70 | 0.58 | 161.4 | 2 | 2 | 2 |
| | A6 | $ZrO_2$ | 1.410 | 26.11 | 2.94 | 186.3 | 2 | 2 | 2 |
| | A7 | $ZrO_2$ | 2.160 | 50.00 | 10.29 | 195.3 | 2 | 2 | 2 |
| | A8 | $ZrO_2$ | 2.350 | 38.39 | 1.63 | 253.8 | 2 | 2 | 2 |
| | A9 | $ZrO_2$ | 3.000 | 35.21 | 1.00 | 320.3 | 2 | 2 | 2 |
| | A10 | ZnO | 0.012 | 0.24 | 1.00 | 119.0 | 2 | 2 | 2 |
| | A11 | ZnO | 0.051 | 1.37 | 1.50 | 121.2 | 2 | 2 | 2 |
| | A12 | ZnO | 1.320 | 45.83 | 2.75 | 183.2 | 2 | 2 | 2 |
| | A13 | ZnO | 2.450 | 33.46 | 40.83 | 192.2 | 2 | 2 | 2 |
| | A14 | ZnO | 2.410 | 32.92 | 1.96 | 249.2 | 2 | 2 | 2 |
| | A15 | ZnO | 3.000 | 32.89 | 1.00 | 320.3 | 2 | 2 | 2 |
| | A16 | ZnO | 0.510 | 10.36 | 0.64 | 159.7 | 2 | 2 | 2 |
| | A17 | $TiO_2$ | 0.012 | 0.31 | 1.00 | 119.0 | 2 | 2 | 2 |
| | A18 | $TiO_2$ | 0.018 | 0.42 | 0.64 | 119.7 | 2 | 2 | 2 |
| | A19 | $TiO_2$ | 0.048 | 0.97 | 0.74 | 122.0 | 2 | 2 | 2 |
| | A20 | $TiO_2$ | 0.510 | 6.96 | 0.64 | 159.7 | 2 | 2 | 2 |
| | A21 | $TiO_2$ | 1.320 | 23.40 | 2.75 | 183.2 | 2 | 2 | 2 |
| | A22 | $TiO_2$ | 2.310 | 27.11 | 1.56 | 253.5 | 2 | 2 | 2 |
| | A23 | $TiO_2$ | 3.000 | 25.51 | 1.00 | 320.3 | 2 | 2 | 2 |
| | A24 | $ZrO_2$ | 2.310 | 25.66 | 1.65 | 251.1 | 2 | 2 | 2 |
| | A25 | $TiO_2$ | 3.000 | 26.88 | 1.00 | 320.3 | 2 | 2 | 2 |
| COMPARATIVE EXAMPLE | a1 | $ZrO_2$ | 0.200 | 0.13 | 0.38 | 118.5 | 1 | 2 | 2 |
| | a2 | — | — | — | — | — | 1 | 2 | 2 |
| | a3 | $ZrO_2$ | 2.100 | 34.31 | 23.33 | 186.4 | 2 | 2 | 1 |
| | a4 | $ZrO_2$ | 1.600 | 26.14 | 10.00 | 177.7 | 2 | 2 | 1 |
| | a5 | $ZrO_2$ | 0.140 | 6.48 | 1.56 | 126.4 | 2 | 1 | 2 |
| | a6 | $ZrO_2$ | 0.510 | 10.36 | 3.19 | 142.8 | 2 | 1 | 2 |
| | a7 | $ZrO_2$ | 3.000 | 23.58 | 0.79 | 334.4 | 2 | 1 | 2 |

Example 2

In the following example, silica was not contained in the aqueous treatment solution used for forming the surface-treated film. The evaluation of the paint film adhesiveness was performed while focusing attention on the contents of the carbon black and the metal oxides in the surface-treated film. The obtained results are shown in Table 3 below.

In Table 3, in invention examples B1, B6 to B8, B13 to B15, B20, and B21 in which the content of carbon black (CB) in the surface-treated film was less than 5 vol % or greater than 40 vol %, or the content of metal oxides in the surface-treated film was less than 1 vol % or greater than 30 vol %, peeling occurred at a part of the paint film, and thus the grade regarding the paint film adhesiveness became 1. On the other hand, in invention examples B2 to B5, B9 to B12, and B16 to B19 in which the content of carbon black (CB) in the surface-treated film was 5 to 40 vol %, and the content of metal oxides in the surface-treated film was 1 to 30 vol %, peeling did not occur in the paint film, and thus the grade regarding the paint film adhesiveness became 2.

From the above results, it was clarified that when the carbon black was contained by 5 to 40 vol % and the metal oxides were contained by 1 to 30 vol %, it was possible to improve the paint film adhesiveness.

TABLE 3

| | | | | | STEEL SHEET FOR HOT STAMPING | | | |
|---|---|---|---|---|---|---|---|---|
| | REFERENCE No. | STEEL No. | TYPE OF PLATING | FILM FORMING METHOD | EMISSIVITY AT 25° C. (%) | EMISSIVITY AT 700° C. (%) | ADHESION AMOUNT OF SILICA ($g/m^2$) | ADHESION AMOUNT OF CARBON BLACK $X_{CB}$ ($g/m^2$) |
| INVENTION EXAMPLE | B1 | S1 | Al-10 MASS % Si | MIXED LAYER | 60 | 55 | 0 | 0.012 |
| | B2 | S2 | Al-10 MASS % Si | MIXED LAYER | 74 | 56 | 0 | 0.060 |
| | B3 | S11 | Al-10 MASS % Si | MIXED LAYER | 77 | 58 | 0 | 0.160 |
| | B4 | S8 | Al-10 MASS % Si | MIXED LAYER | 81 | 76 | 0 | 0.210 |
| | B5 | S5 | Al-10 MASS % Si | MIXED LAYER | 84 | 74 | 0 | 0.480 |
| | B6 | S12 | Al-10 MASS % Si | MIXED LAYER | 86 | 58 | 0 | 0.800 |
| | B7 | S1 | Al-10 MASS % Si | MIXED LAYER | 80 | 71 | 0 | 0.090 |
| | B8 | S6 | Al-10 MASS % Si | MIXED LAYER | 65 | 56 | 0 | 0.034 |
| | B9 | S7 | Al-10 MASS % Si | MIXED LAYER | 74 | 56 | 0 | 0.060 |
| | B10 | S8 | Al-10 MASS % Si | MIXED LAYER | 77 | 58 | 0 | 0.160 |
| | B11 | SS | Al-10 MASS % Si | MIXED LAYER | 83 | 75 | 0 | 0.460 |
| | B12 | S10 | Al-10 MASS % Si | MIXED LAYER | 83 | 71 | 0 | 0.480 |
| | B13 | S13 | Al-10 MASS % Si | MIXED LAYER | 86 | 58 | 0 | 0.800 |
| | B14 | S14 | Al-10 MASS % Si | MIXED LAYER | 80 | 71 | 0 | 0.100 |
| | B15 | S15 | Al-10 MASS % Si | MIXED LAYER | 60 | 54 | 0 | 0.012 |
| | B16 | S12 | Al-10 MASS % Si | MIXED LAYER | 74 | 56 | 0 | 0.060 |
| | B17 | S3 | NO PLATING | MIXED LAYER | 77 | 68 | 0 | 0.160 |
| | B18 | S4 | Al-10 MASS % Si | MIXED LAYER | 79 | 75 | 0 | 0.390 |
| | B19 | S5 | Al-10 MASS % Si | MIXED LAYER | 82 | 72 | 0 | 0.480 |
| | B20 | S5 | Al-10 MASS % Si | MIXED LAYER | 84 | 58 | 0 | 0.800 |
| | B21 | S10 | Al-10 MASS % Si | MIXED LAYER | 79 | 78 | 0 | 0.080 |

| | | STEEL SHEET FOR HOT STAMPING | | | | | | |
|---|---|---|---|---|---|---|---|---|
| | | METAL OXIDE | | | | | | |
| | REFERENCE No. | TYPE | ADHESION AMOUNT $X_{oxide}$ ($g/m^2$) | ADHESION AMOUNT RATIO $X_{oxide}/X_{CB}$ | CONTENT OF CARBON BLACK (VOL %) | CONTENT OF METAL OXIDE (VOL %) | MIDDLE SIDE OF EQUATION (1) | PROPERTY PAINT ADHESIVENESS |
| INVENTION EXAMPLE | B1 | $ZrO_2$ | 0.012 | 1.00 | 1.0 | 0.2 | 119.0 | 1 |
| | B2 | $ZrO_2$ | 0.070 | 1.17 | 5.0 | 1.0 | 122.7 | 2 |
| | B3 | $ZrO_2$ | 0.510 | 3.19 | 13.3 | 7.1 | 142.8 | 2 |
| | B4 | $ZrO_2$ | 2.160 | 10.29 | 17.5 | 30.0 | 195.3 | 2 |
| | B5 | $ZrO_2$ | 1.410 | 2.94 | 40.0 | 19.6 | 186.3 | 2 |
| | B6 | $ZrO_2$ | 0.510 | 0.64 | 66.7 | 7.1 | 159.7 | 1 |
| | B7 | $ZrO_2$ | 2.450 | 27.22 | 7.5 | 34.0 | 194.3 | 1 |
| | B8 | $ZrO_2$ | 0.051 | 1.50 | 2.8 | 0.7 | 121.2 | 1 |
| | B9 | $ZrO_2$ | 0.070 | 1.17 | 5.0 | 1.0 | 122.7 | 2 |
| | B10 | $ZrO_2$ | 0.510 | 3.19 | 13.3 | 7.1 | 142.8 | 2 |
| | B11 | $ZrO_2$ | 2.160 | 4.70 | 14.3 | 30.0 | 208.9 | 2 |
| | B12 | $ZrO_2$ | 1.320 | 2.75 | 40.0 | 18.3 | 183.2 | 2 |
| | B13 | $ZrO_2$ | 0.510 | 0.64 | 66.7 | 7.1 | 159.7 | 1 |
| | B14 | $ZrO_2$ | 2.450 | 24.50 | 8.3 | 34.0 | 195.0 | 1 |
| | B15 | $TiO_2$ | 0.012 | 1.00 | 1.0 | 0.2 | 119.0 | 1 |
| | B16 | $TiO_2$ | 0.070 | 1.17 | 5.0 | 1.0 | 122.7 | 2 |
| | B17 | $TiO_2$ | 0.510 | 3.19 | 13.3 | 7.1 | 142.8 | 2 |

TABLE 3-continued

| | | | | | | | |
|---|---|---|---|---|---|---|---|
| B18 | $TiO_2$ | 2.160 | 5.54 | 32.5 | 30.0 | 205.3 | 2 |
| B19 | $TiO_2$ | 1.320 | 2.75 | 40.0 | 18.3 | 183.2 | 2 |
| B20 | $TiO_2$ | 0.510 | 0.64 | 66.7 | 7.1 | 159.7 | 1 |
| B21 | $TiO_2$ | 2.450 | 30.63 | 6.7 | 34.0 | 193.6 | 1 |

Example 3

In the following example, silica was not contained in the aqueous treatment solution used for forming the surface-treated film. The evaluation of the heating rate was performed while focusing attention on the ratio of adhesion amounts of the carbon black and the metal oxides in the surface-treated film. Note that in the present example, the evaluation was performed regarding the heating rate until when the temperature reached 910° C. from, not the room temperature but 500° C. The evaluation criteria are as follows. The obtained results are shown in Table 4 below.

(Grade)

2: Heating rate of 1.3° C./s or more

1: Heating rate of less than 1.3° C./s

In Table 4, in C1, C7, C8, C14, C15, and C21 in which the ratio $X_{Oxide}/X_{CB}$ between the adhesion amount of the carbon black and the adhesion amount of the metal oxides was less than 0.20 or greater than 200.00, the heating rate until when the temperature reached 910° C. from 500° C. became less than 1.3° C./s, and thus the grade became 1. On the other hand, in C2 to C6, C9 to C13, and C16 to C20 in which the ratio $X_{Oxide}/X_{CB}$ between the adhesion amount of the carbon black and the adhesion amount of the metal oxides was 0.20 to 200.00, the heating rate until when the temperature reached 910° C. from 500° C. became 1.3° C./s or more, and thus the grade became 2.

TABLE 4

| | | | | | STEEL SHEET FOR HOT STAMPING | | | |
|---|---|---|---|---|---|---|---|---|
| | REFERENCE No. | STEEL No. | TYPE OF PLATING | FILM FORMING METHOD | EMISSIVITY AT 25° C. (%) | EMISSIVITY AT 700° C. (%) | ADHESION AMOUNT OF SILICA ($g/m^2$) | ADHESION AMOUNT OF CARBON BLACK $X_{CB}$ ($g/m^2$) |
| INVENTION EXAMPLE | C1 | S1 | Al-10 MASS % Si | MIXED LAYER | 84 | 53 | 0 | 1.050 |
| | C2 | S5 | Al-10 MASS % Si | MIXED LAYER | 94 | 61 | 0 | 3.000 |
| | C3 | S8 | Al-10 MASS % Si | MIXED LAYER | 60 | 63 | 0 | 0.012 |
| | C4 | S8 | Al-10 MASS % Si | MIXED LAYER | 64 | 61 | 0 | 0.037 |
| | C5 | S3 | Al-10 MASS % Si | MIXED LAYER | 65 | 60 | 0 | 0.042 |
| | C6 | S11 | Al-10 MASS % Si | MIXED LAYER | 63 | 74 | 0 | 0.015 |
| | C7 | S12 | Al-10 MASS % Si | MIXED LAYER | 62 | 61 | 0 | 0.010 |
| | C8 | S14 | Al-10 MASS % Si | MIXED LAYER | 72 | 51 | 0 | 0.850 |
| | C9 | S2 | Al-10 MASS % Si | MIXED LAYER | 92 | 63 | 0 | 2.000 |
| | C10 | S16 | Al-10 MASS % Si | MIXED LAYER | 60 | 61 | 0 | 0.012 |
| | C11 | S17 | Al-10 MASS % Si | MIXED LAYER | 66 | 68 | 0 | 0.035 |
| | C12 | S18 | Al-10 MASS % Si | MIXED LAYER | 74 | 70 | 0 | 0.024 |
| | C13 | S8 | Al-10 MASS % Si | MIXED LAYER | 71 | 75 | 0 | 0.012 |
| | C14 | S5 | Al-10 MASS % Si | MIXED LAYER | 74 | 71 | 0 | 0.009 |
| | C15 | S10 | Al-10 MASS % Si | MIXED LAYER | 75 | 53 | 0 | 0.910 |
| | C16 | S7 | Al-10 MASS % Si | MIXED LAYER | 93 | 60 | 0 | 2.100 |
| | C17 | S1 | Al-10 MASS % Si | MIXED LAYER | 60 | 59 | 0 | 0.015 |
| | C18 | S3 | Al-10 MASS % Si | MIXED LAYER | 72 | 63 | 0 | 0.033 |
| | C19 | S2 | Al-10 MASS % Si | MIXED LAYER | 66 | 68 | 0 | 0.020 |
| | C20 | S4 | Al-10 MASS % Si | MIXED LAYER | 68 | 73 | 0 | 0.014 |
| | C21 | S5 | Al-10 MASS % Si | MIXED LAYER | 69 | 71 | 0 | 0.010 |

| | | STEEL SHEET FOR HOT STAMPING | | | | | | |
|---|---|---|---|---|---|---|---|---|
| | | | METAL OXIDE | | | | | |
| | REFERENCE No. | CONTENT OF CARBON BLACK (VOL %) | TYPE | ADHESION AMOUNT Xoxide (g/m2) | CONTENT (VOL %) | ADHESION AMOUNT RATIO $X_{oxide}/X_{CB}$ | MIDDLE SIDE OF EQUATION (1) | PROPERTY HEATING RATE AT 500° C. OR MORE |
| INVENTION EXAMPLE | C1 | 24.30 | $ZrO_2$ | 0.120 | 2.77 | 0.11 | 144.6 | 1 |
| | C2 | 35.20 | $ZrO_2$ | 0.600 | 7.04 | 0.20 | 191.3 | 2 |
| | C3 | 0.30 | $ZrO_2$ | 0.012 | 0.30 | 1.00 | 119.0 | 2 |
| | C4 | 0.75 | $ZrO_2$ | 0.580 | 11.78 | 15.68 | 140.8 | 2 |
| | C5 | 2.33 | $ZrO_2$ | 0.053 | 2.94 | 1.26 | 121.5 | 2 |
| | C6 | 0.20 | $ZrO_2$ | 3.000 | 40.98 | 200.00 | 199.6 | 2 |
| | C7 | 0.16 | $ZrO_2$ | 2.300 | 37.58 | 230.00 | 185.5 | 1 |
| | C8 | 22.84 | $ZrO_2$ | 0.012 | 0.32 | 0.01 | 136.1 | 1 |
| | C9 | 39.60 | $ZrO_2$ | 0.400 | 7.93 | 0.20 | 171.0 | 2 |
| | C10 | 0.71 | $ZrO_2$ | 0.021 | 1.25 | 1.75 | 119.4 | 2 |

TABLE 4-continued

| | | | | | | | |
|---|---|---|---|---|---|---|---|
| C11 | 0.91 | $ZrO_2$ | 0.950 | 24.73 | 27.14 | 152.6 | 2 |
| C12 | 0.80 | $ZrO_2$ | 1.350 | 45.00 | 56.25 | 163.5 | 2 |
| C13 | 0.28 | $ZrO_2$ | 2.400 | 57.14 | 200.00 | 187.7 | 2 |
| C14 | 0.25 | $ZrO_2$ | 2.100 | 60.34 | 233.33 | 181.1 | 1 |
| C15 | 22.30 | $TiO_2$ | 0.012 | 0.29 | 0.01 | 137.0 | 1 |
| C16 | 34.31 | $TiO_2$ | 0.420 | 6.86 | 0.20 | 173.1 | 2 |
| C17 | 0.69 | $TiO_2$ | 0.025 | 1.15 | 1.67 | 119.6 | 2 |
| C18 | 1.30 | $TiO_2$ | 1.030 | 40.87 | 31.21 | 154.9 | 2 |
| C19 | 0.57 | $TiO_2$ | 1.530 | 43.96 | 76.50 | 168.1 | 2 |
| C20 | 0.22 | $TiO_2$ | 2.800 | 45.75 | 200.00 | 195.8 | 2 |
| C21 | 0.16 | $TiO_2$ | 2.300 | 36.85 | 230.00 | 185.5 | 1 |

Example 4

In the following example, silica was not contained in the aqueous treatment solution used for forming the surface-treated film. The evaluation of the paint film corrosion resistance after hot stamping was performed while focusing attention on the adhesion amounts of the carbon black and the metal oxides in the surface-treated film. The obtained results are shown in Table 5 below.

In Table 5, in invention examples D1, D4, and D7 in which the adhesion amount of the carbon black was less than 0.030 g/m$^2$ or the adhesion amount of the metal oxides was less than 0.030 g/m$^2$, the blister width of the paint film after the hot stamping became 3 mm or more, and thus the grade became 1. On the other hand, in invention examples D2, D3, D5, D6, D8, and D9 in which the adhesion amount of the carbon black was 0.030 g/m$^2$ or more and the adhesion amount of the metal oxides was 0.030 g/m$^2$ or more, the blister width of the paint film after the hot stamping became less than 3 mm, and thus the grade became 2.

TABLE 5

| | | | | | STEEL SHEET FOR HOT STAMPING | | | |
|---|---|---|---|---|---|---|---|---|
| | REFERENCE No. | STEEL No. | TYPE OF PLATING | FILM FORMING METHOD | EMISSIVITY AT 25° C. (%) | EMISSIVITY AT 700° C. (%) | ADHESION AMOUNT OF SILICA (g/m$^2$) | ADHESION AMOUNT OF CARBON BLACK $X_{CB}$ (g/m$^2$) |
| INVENTION EXAMPLE | D1 | S10 | Al-10 MASS % Si | MIXED LAYER | 64 | 56 | 0 | 0.014 |
| | D2 | S7 | Al-10 MASS % Si | MIXED LAYER | 65 | 57 | 0 | 0.030 |
| | D3 | S1 | Al-10 MASS % Si | MIXED LAYER | 71 | 63 | 0 | 0.110 |
| | D4 | S5 | Al-10 MASS % Si | MIXED LAYER | 65 | 55 | 0 | 0.015 |
| | D5 | S2 | Al-10 MASS % Si | MIXED LAYER | 67 | 56 | 0 | 0.030 |
| | D6 | S15 | Al-10 MASS % Si | MIXED LAYER | 81 | 62 | 0 | 0.350 |
| | D7 | S10 | Al-10 MASS % Si | MIXED LAYER | 63 | 54 | 0 | 0.012 |
| | D8 | S7 | Al-10 MASS % Si | MIXED LAYER | 69 | 58 | 0 | 0.030 |
| | D9 | S1 | Al-10 MASS % Si | MIXED LAYER | 80 | 67 | 0 | 0.280 |

| | STEEL SHEET FOR HOT STAMPING | | | | | | | PROPERTY PAINT FILM |
|---|---|---|---|---|---|---|---|---|
| | | CONTENT | METAL OXIDE | | | | | |
| | REFERENCE No. | OF CARBON BLACK (VOL %) | TYPE | ADHESION AMOUNT Xoxide (g/m2) | CONTENT (VOL %) | ADHESION AMOUNT RATIO $X_{oxide}/X_{CB}$ | MIDDLE SIDE OF EQUATION (1) | CORROSION RESISTANCE AFTER HOT STAMPING |
| INVENTION EXAMPLE | D1 | 1.45 | $ZrO_2$ | 0.013 | 1.35 | 0.93 | 119.1 | 1 |
| | D2 | 1.78 | $ZrO_2$ | 0.030 | 1.79 | 1.00 | 120.2 | 2 |
| | D3 | 6.54 | $ZrO_2$ | 0.280 | 16.67 | 2.55 | 132.5 | 2 |
| | D4 | 0.35 | ZnO | 0.011 | 0.26 | 0.73 | 119.0 | 1 |
| | D5 | 1.04 | ZnO | 0.030 | 1.04 | 1.00 | 120.2 | 2 |
| | D6 | 11.21 | ZnO | 0.220 | 7.05 | 0.63 | 136.7 | 2 |
| | D7 | 0.32 | $TiO_2$ | 0.017 | 0.46 | 1.42 | 119.2 | 1 |
| | D8 | 2.27 | $TiO_2$ | 0.030 | 2.27 | 1.00 | 120.2 | 2 |
| | D9 | 16.66 | $TiO_2$ | 0.250 | 14.80 | 0.89 | 136.2 | 2 |

Preferred embodiments of the present invention have been described above in detail, but the present invention is not limited to the embodiments. It should be understood that various changes and modifications are readily apparent to those skilled in the art who has the common general knowledge in the technical field to which the present invention pertains, within the scope of the technical spirit as set forth in claims, and they should also be covered by the technical scope of the present invention.

What is claimed is:

1. A steel sheet for hot stamping comprising, on the whole of at least one surface of the steel sheet, a surface-treated film whose emissivity at a wavelength of 8.0 μm at 25° C. is 60% or more, wherein:

the surface-treated film contains carbon black, and one or more of a Zr oxide, a Zn oxide, and a Ti oxide, in which the carbon black and the oxides exist while being dispersed over the entire surface-treated film;

the surface-treated film has a silica content of 0 to 0.3 $g/m^2$;

when an adhesion amount of the carbon black and an adhesion amount of the oxides are set to $X_{CB}$ ($g/m^2$) and $X_{Oxide}$ ($g/m^2$), respectively, an equation (1) below is satisfied, $$118.9 \leq 24280/\{6700/(100+76\times X_{CB})+18000/(130+65\times X_{Oxide})\} \leq 332.0 \quad \text{Equation (1), and}$$

on one side or both sides of the steel sheet for hot stamping, a metal-plated layer is provided between a base material of the steel sheet and the surface-treated film, wherein the metal-plated layer is aluminum plating, or Al—Si plating.

2. The steel sheet for hot stamping according to claim 1, wherein the surface-treated film contains the carbon black of 5.0 to 40.0 vol %, and contains the oxides of 1.0 to 30.0 vol %.

3. The steel sheet for hot stamping according to claim 1, wherein a ratio $X_{Oxide}/X_{CB}$ between the adhesion amount $X_{CB}$ ($g/m^2$) of the carbon black and the adhesion amount $X_{Oxide}$ ($g/m^2$) of the oxides is 0.20 or more and 200.00 or less.

4. The steel sheet for hot stamping according to claim 1, wherein the adhesion amount $X_{CB}$ of the carbon black is 0.030 $g/m^2$ or more, and the adhesion amount $X_{Oxide}$ of the oxides is 0.030 $g/m^2$ or more.

5. The steel sheet for hot stamping according to claim 1, wherein an emissivity of the surface-treated film at a wavelength of 8.0 μm at 700° C. is 60% or more.

6. A hot-stamped member, comprising the steel sheet according to claim 1 and having the surface-treated film on the whole of at least one surface of the steel sheet, wherein:

the surface-treated film contains one or more of the Zr oxide, the Zn oxide, and the Ti oxide, in which the adhesion amount $X_{Oxide}$ of the oxides is 0.030 $g/m^2$ or more; and the surface-treated film has the silica content of 0 to 0.3 $g/m^2$.

* * * * *